US005395490A

United States Patent [19]

Hoff et al.

[11] Patent Number: 5,395,490

[45] Date of Patent: Mar. 7, 1995

[54] METHOD FOR TREATING MATERIALS BY THE APPLICATION OF ELECTROMAGNETIC ENERGY AT RESONANT ABSORPTION FREQUENCIES

[75] Inventors: Don G. Hoff, Tiburon, Calif.; Joseph F. Stiley, III, Spokane, Wash.

[73] Assignee: Intertec, Ltd., Mill Valley, Calif.

[21] Appl. No.: 61,442

[22] Filed: May 14, 1993

[51] Int. Cl.[6] ..... A45D 7/00

[52] U.S. Cl. ..... 204/132; 204/157.15

[58] Field of Search ..... 204/131, 132, 157.15

[56] References Cited

U.S. PATENT DOCUMENTS 3,863,653 2/1975 Boudouris et al. ..... 132/33

3,980,855 9/1976 Boudouris et al. ..... 219/10.55 A

*Primary Examiner*—John Niebling

*Assistant Examiner*—Arun S. Phasge

*Attorney, Agent, or Firm*—Ronald S. Laurie

[57] ABSTRACT

A method for changing a characteristic of a material is provided. The characteristic of the material is determined by the nature of the bond coupling certain molecular components in the material. The material is exposed to electromagnetic energy having a frequency range related to the bond coupling two molecular components in the material. During the time the material is exposed to the electromagnetic energy, stress is applied to the material. As a result, the bond is broken and then subsequently a different bond is formed by the simultaneous application of the stress and the electromagnetic energy. The structure of the new bond is determined in part by the stress.

16 Claims, 6 Drawing Sheets

METHOD FOR TREATING MATERIALS BY THE APPLICATION OF ELECTROMAGNETIC ENERGY AT RESONANT ABSORPTION FREQUENCIES

FIELD OF THE INVENTION

The present invention relates to the treatment of materials to alter one or more physical characteristics or attributes by the application of electromagnetic energy at the resonant frequencies of particular molecular bonds within the material. One of the primary applications of the invention involves altering the shape of keratinic fibers such as human hair, and is more particularly directed to a method for permanently waving or straightening hair without the use of caustic chemicals or uncomfortably high temperatures by exposing the hair to electromagnetic energy at selected frequencies.

BACKGROUND OF THE PRIOR ART

The use of chemicals in the treatment of human hair to achieve a "permanent wave," or "perm," is well known. These processes typically involve the following steps. First, in the "reduction" process, an acid-based chemical solution is applied to the hair and the hair is subjected to mechanical stress by forcing the hair to assume the desired new shape, e.g., by winding a lock of hair around a roller, whereby the combination of mechanical stress and chemical action breaks or "cleaves" the disulfide bonds which link the protein molecules within the hair and are primarily responsible for giving the hair its natural shape. Next, the hair is rinsed to remove as much of the chemical treatment solution as possible and to neutralize any solution which remains in the hair, thereby slowing and eventually stopping the cleavage of disulfide bonds. Next, the hair is treated with an oxidizing agent, such as hydrogen peroxide, which reconstitutes or reforms the broken disulfide bonds in a manner which causes the hair to naturally assume a new shape determined by the applied mechanical stress, and to maintain that shape after the source of the stress is removed. Finally, the hair is removed from the rollers and is rinsed to remove the oxidizing agent. The chemicals used in the conventional permanent wave treatment of hair are so caustic that if the process is repeated too often over a given time period, e.g., more than twice in a year, permanent damage to the hair will result.

It is also well known that the chemical processes described above can be accelerated by the application of heat to the hair mass during the chemical treatment, such as by placing the subject's head in a drying hood. However, because the heat absorption characteristics of keratinic material are very poor, the process of transferring externally applied heat into the interior of the hair shaft is very inefficient and requires uncomfortably high temperatures for relatively long periods.

To solve the heat transfer problem, it has been suggested, in effect, to heat the hair fibers from the inside out rather than from the outside in by the application of an electromagnetic field to the hair during the chemical treatment. The electromagnetic field causes dielectric losses inside the hair fibers which in turn raises the temperature of the fibers from within. One such approach is described in U.S. Pat. No. 3,863,653 issued to Boudouris et al. This technique, however, merely accelerates the chemical reactions, thereby reducing the time that the hair must be exposed to the potentially damaging chemicals, but does not avoid the cumulative adverse effects on the hair, and the environment, caused by these highly caustic agents.

SUMMARY OF THE INVENTION.

The present invention eliminates the need for the use of caustic chemicals and extreme heat in permanently altering the shape of hair by waving or straightening (collectively described herein as a permanent wave). This is accomplished by using a process which can be described as resonant frequency transfer, hereinafter referred to as "RFT." RFT involves the direct coupling of electromagnetic energy from an external source into the disulfide bonds within the hair shaft at the natural, or resonant, frequencies of the bond, i.e., the frequencies at which energy absorption is most efficient and effective. The result of this resonant energy coupling is that cleavage of the disulfide bonds occurs at a rate which is more than sufficient to result in a permanent wave without the use of chemicals. Specifically, it is estimated that a permanent wave can be effected if between 5% and 20% of the disulfide bonds within the hair fiber are cleaved and reformed.

With the use of RFT, the reduction process, being electronic, is fast and clean as there is no need to apply, and thus to remove or to neutralize, such chemicals. Thus the permanent wave treatment process takes much less time and is far less "messy" than with conventional methods. More importantly, the process can be repeated more often than with conventional chemical perming processes without long term damage to the hair, or to the environment. Because the energy is "targeted" to its intended purpose, i.e., disulfide bond cleavage, by application of a particular range of frequencies, it is not necessary to expose the subject to uncomfortably high levels of heat generated by generalized dielectric heating of the hair as in the prior art.

It is also known that the effectiveness of disulfide bond cleavage can be accelerated by raising the temperature of the water molecules within the hair shaft in the vicinity of the disulfide bonds. According to a preferred embodiment of the invention, the electromagnetic field to which the hair is exposed includes a frequency component which causes the vibration of water molecules.

In addition to using RFT on human hair, the RFT approach can be advantageously used in connection with other types of keratinic materials, including animal hair such as wool, as well as certain types of synthetic fibers and other polymers.

BRIEF DESCRIPTION OF THE DRAWINGS

The present invention will be better and more completely understood by referring to the following detailed description of preferred embodiments in conjunction with the attached drawings, of which.

DETAILED DESCRIPTION OF PREFERRED EMBODIMENTS

The following is a description of the preferred method of altering the shape of keratinic fibers using RFT (hereinafter referred to as the "RFT Method"). Although the RFT Method may be effectively applied to various types of keratinic fibers, it is preferably used to create a permanent wave in normally straight hair fibers or to straighten normally curly hair fibers, both of which will be referred to herein as "perming" hair. The primary advantage of the RFT Method over prior art perming methods is that the RFT Method is effective without the use of caustic chemicals or uncomfortably high temperatures.

Figure 1:
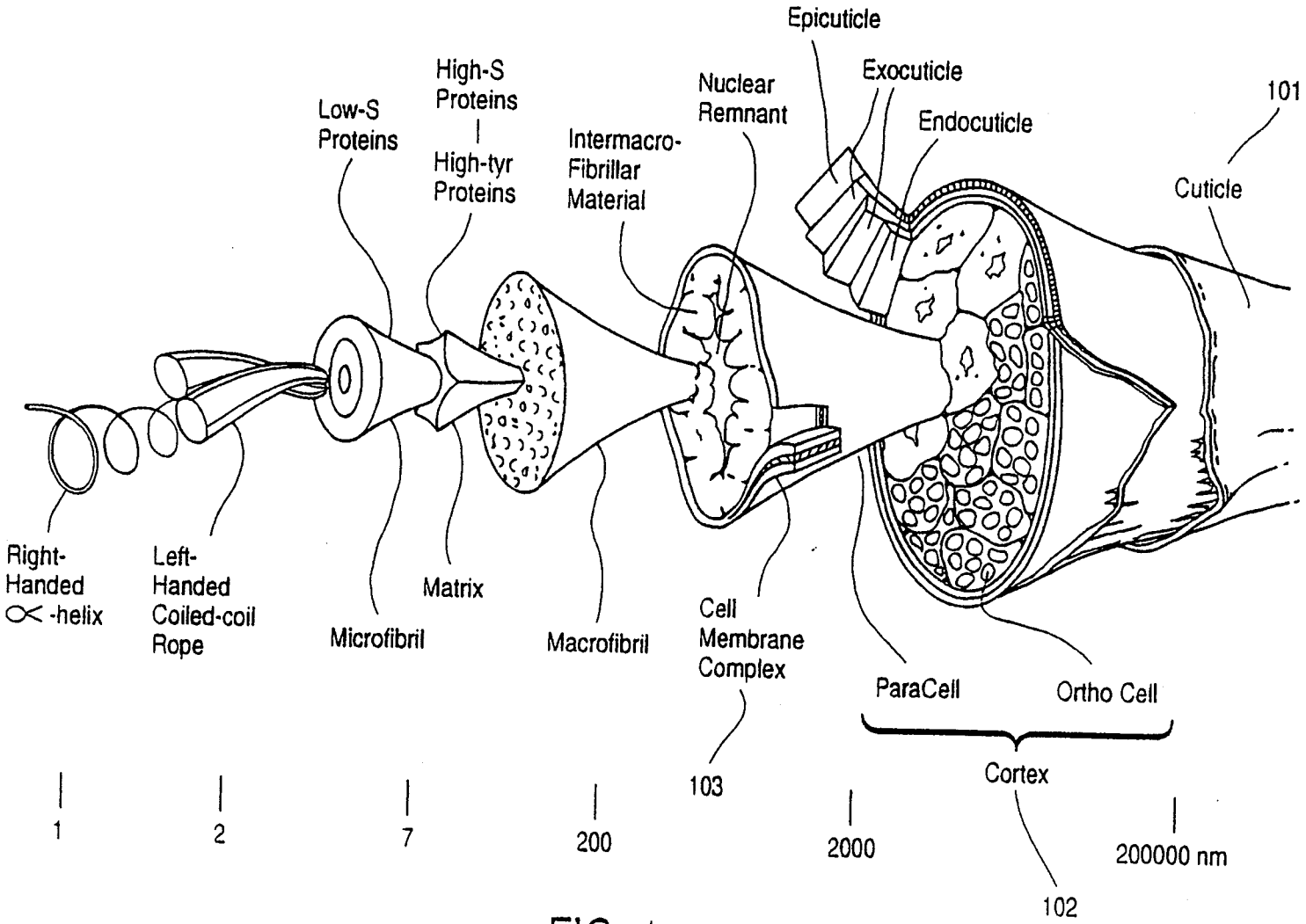
FIG. 1 is a detailed drawing of the molecular structure of a hair fiber.
Figure 2A:
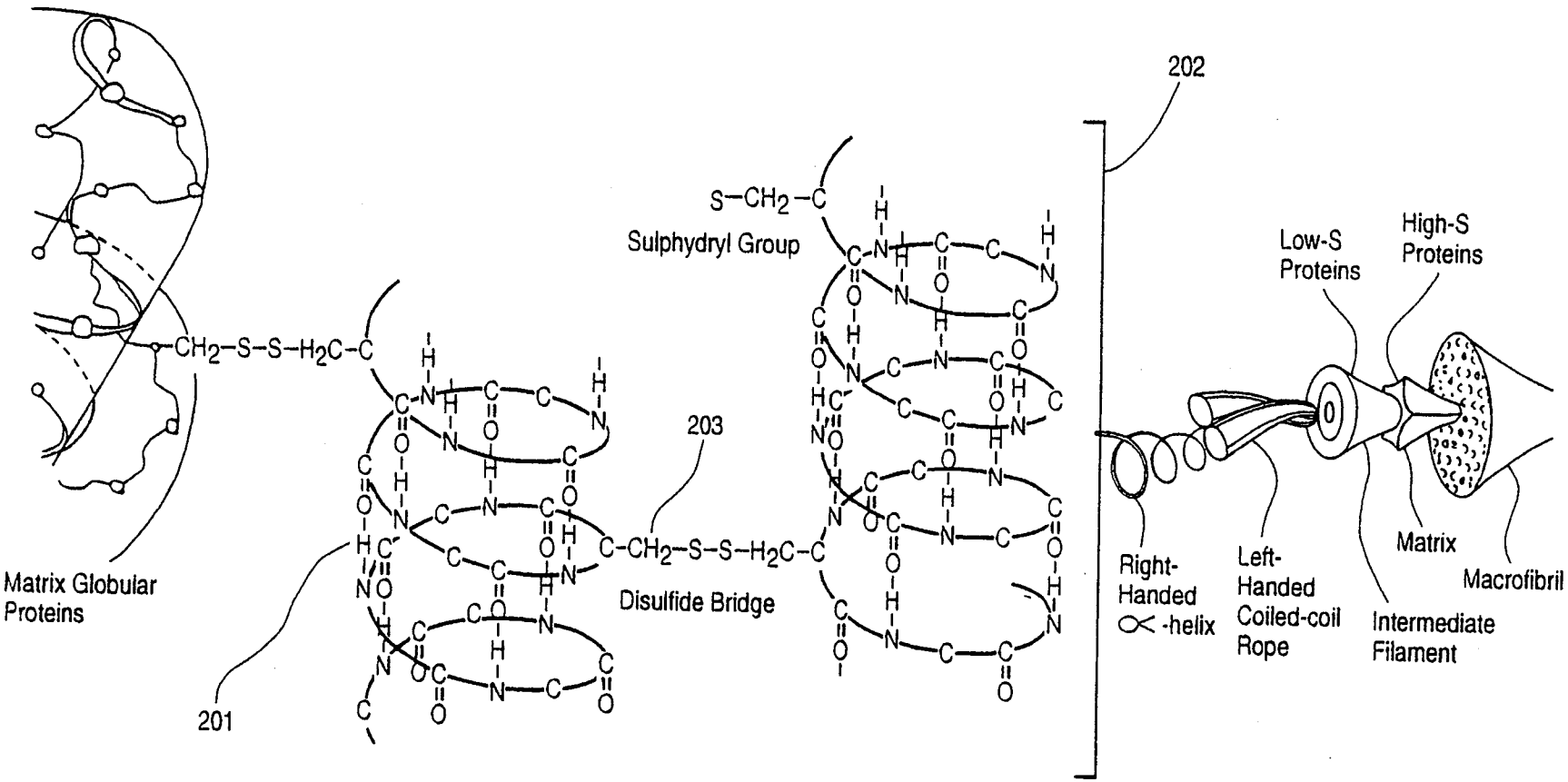
FIG. 2A is a schematic drawing of various types of bonds which link protein components within the hair fiber.

A brief discussion of the molecular structure of hair may be useful in understanding the efficacy of the RFT Method. FIG. 1 shows the molecular structure of a strand of hair. As illustrated in FIG. 1, each hair fiber consists of essentially three main morphological components: the cuticle 101, the cortex 102, and the cell membrane complex 103. Each cell membrane complex 103 is composed of a protein matrix of keratin peptide chains such as cystine. The protein components of the cell membrane complex 103 are linked by bonds known as disulfide bonds. The natural shape of the hair fiber is controlled by the orientation of the disulfide bonds which link the protein chains. FIG. 2A is a schematic drawing of the various types of linkages that contribute to the structural integrity of the hair fiber, including hydrogen bonds 201, helical sulfhydryl groups 202, and disulfide bonds 203. The disulfide bonds 203 between the sulfhydryl groups 202 are believed to be the primary mechanism that establishes the structural stability of hair and imparts its natural shape.

Alteration of the disulfide bonds 203 is necessary to achieve long term structural changes in the shape of hair. Conditions that do not cause the cleavage and reformation of disulfide bonds 203 will only result in temporary changes. For example, the use of heat and moisture to style hair may create temporary waving of the hair; however, the styled hair will return to its natural shape after a short period of time as a result of exposure to moisture in the air. This is because use of heat and moisture to style hair merely breaks and reforms the hydrogen bonds 201. The newly formed hydrogen bonds 201 are insufficient to hold the shape of hair for a significant period of time because the stronger disulfide bonds 203 eventually force the styled hair to reassume its original shape. Thus, a permanent change in the shape of hair may be achieved only by cleaving and reforming the disulfide bonds 203.

Figure 2B:
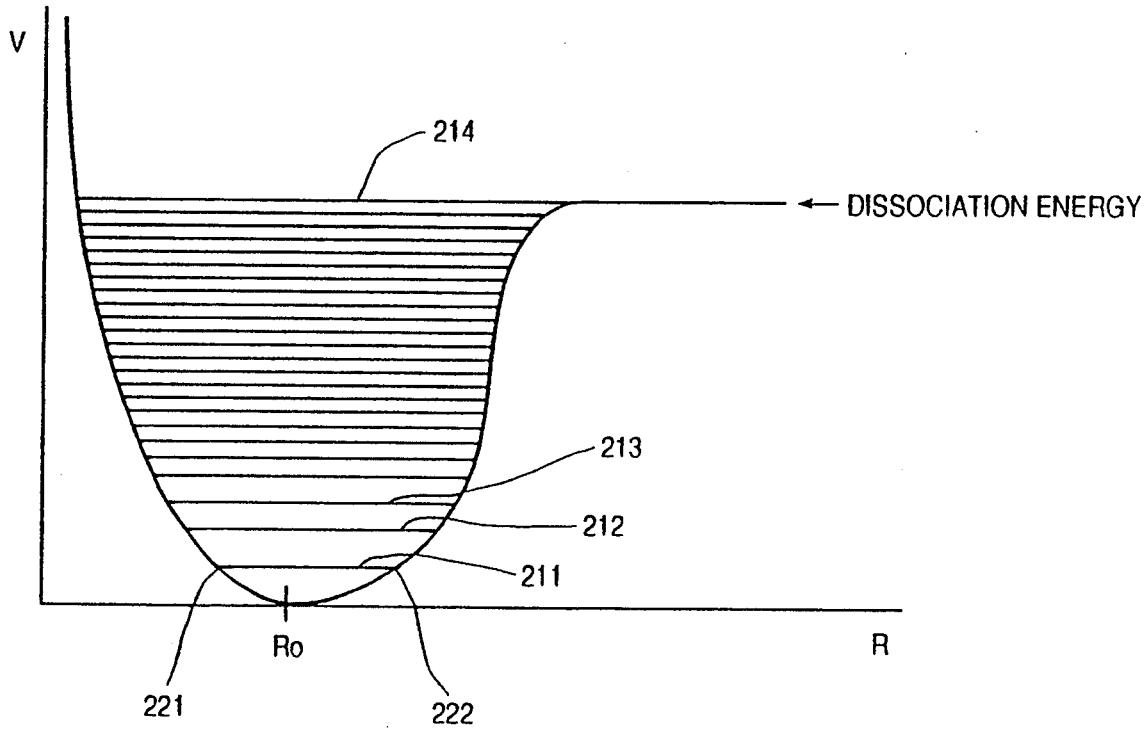
FIG. 2B is an energy level diagram of a disulfide bond linking two sulfur atoms.

It is well known that the state of a bond, such as the disulfide bond linking protein chains in hair, is governed by the laws of quantum mechanics, and that the energy of the bond can only exist at discrete energy levels. FIG. 2B is an energy level diagram wherein the vertical axis corresponds to the potential energy (V) of a disulfide bond and the horizontal axis corresponds to the distance (R) between two sulfur atoms. At any given time, a particular bond can only be at one of the energy levels indicated by the horizontal lines, such as levels 211, 212, and 213. That is, at each energy level, the line bounded by the parabolic-shaped curve corresponds to the limits of vibrational extension of the bond. Thus, at energy level 211, the maximum length of the bond is indicated by the distance between points 221 and 222.

The energy of the bond can change from one level to another by absorbing or emitting a discrete amount of energy. For example, when the bond absorbs an amount of energy ($\Delta E_1$) equal to the difference between the energy at levels 212 and 211, the energy level of the bond jumps from 211 to 212. Similarly, when the bond emits an amount of energy equal to $AE_1$, the energy level changes from 212 back to 211.

One way for the bond to absorb energy is by exposing the bond to electromagnetic energy having a frequency determined by Planck's formula, $\Delta E = hv$, where $\Delta E$ is the energy difference between the two energy levels, h is Planck's constant, and v is the frequency of the electromagnetic energy. Using Planck's formula, it can be calculated that electromagnetic radiation having a frequency of about $2*10^{13}$ hertz should be applied to a disulfide bond in order to change its energy from level 211 to level 212.

FIG. 2B also indicates that when the bond absorbs a sufficient amount of energy, it reaches a dissociation energy level 214 whereupon the molecular components initially attached by the bond can separate from one another and become free radicals. In order for the bond to move from a low energy level, such as level 211, to the dissociation energy level 214, a number of discrete quantum jumps need to take place. According to Planck's formula, each of these quantum jumps has an associated frequency. As a result, in order to achieve cleavage, the bond must be exposed to electromagnetic energy having a range of frequencies which will excite the appropriate percentage of disulfide bonds (at various energy levels) to their dissociation energy level. For the simplified case of an isolated $S_2$ molecule, the frequencies which correspond to the various quantum jumps are between $2*10^{13}$ hertz and $1*10^{15}$ hertz. Because the sulfur atoms in hair are also bonded to many other atoms, and the molecule is in a solid form, the preferred frequency range of the electromagnetic energy used for perming hair is between $1*10^{13}$ hertz and $2*10^{15}$ hertz.

It has been observed that coupling electromagnetic energy to the bond is not sufficient by itself to raise the energy of the bond to the dissociation level. It is believed that this is because the electromagnetic energy is rapidly transferred to the neighboring atoms of the protein components attached by the bond, thereby resulting in the heating of the hair instead of effectuating the desired quantum jumps. An excess amount of heat could break up the molecular structure of the protein matrices, thereby producing a detrimental effect on the hair. On the other hand, the normal mechanical stress produced by winding hair around a typical hair roller, when combined with the application of electromagnetic energy at the appropriate resonant frequencies, is sufficient to achieve cleavage of a sufficient number of disulfide bonds to permanently alter the shape of the hair.

One of the advantages of cleaving disulfide bonds by electronic rather than chemical means is that the cleaving process can be instantly terminated at any time by turning off the source of electromagnetic energy. The bonds in a high energy level state will return to a low energy level automatically by emitting energy. In contrast, prior art cleaving methods using chemicals cannot be easily and quickly terminated once the chemicals have been applied to the hair.

The preferred method of perming hair using RFT typically involves three distinct stages: (1) the stress initiation stage, (2) the RFT application stage, and (3) the reconfiguration stage.

Figure 3:
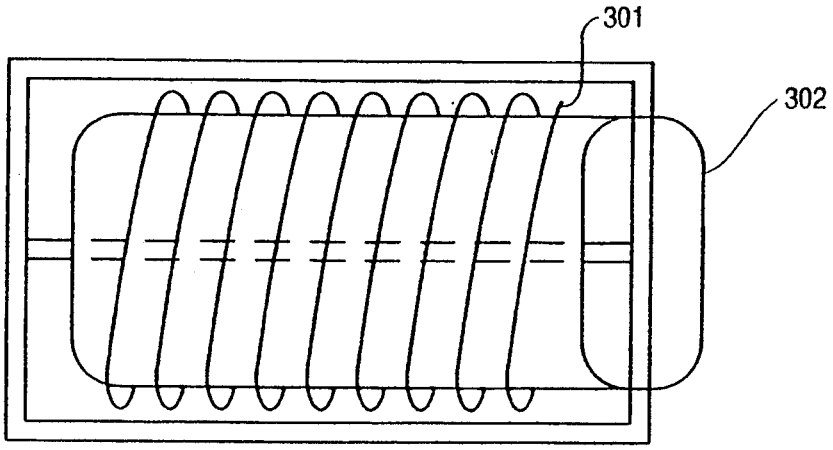
FIG. 3 is a drawing depicting the application of external stress to a hair fiber by curling it around a hair roller in accordance with the present invention.
Figure 4A:
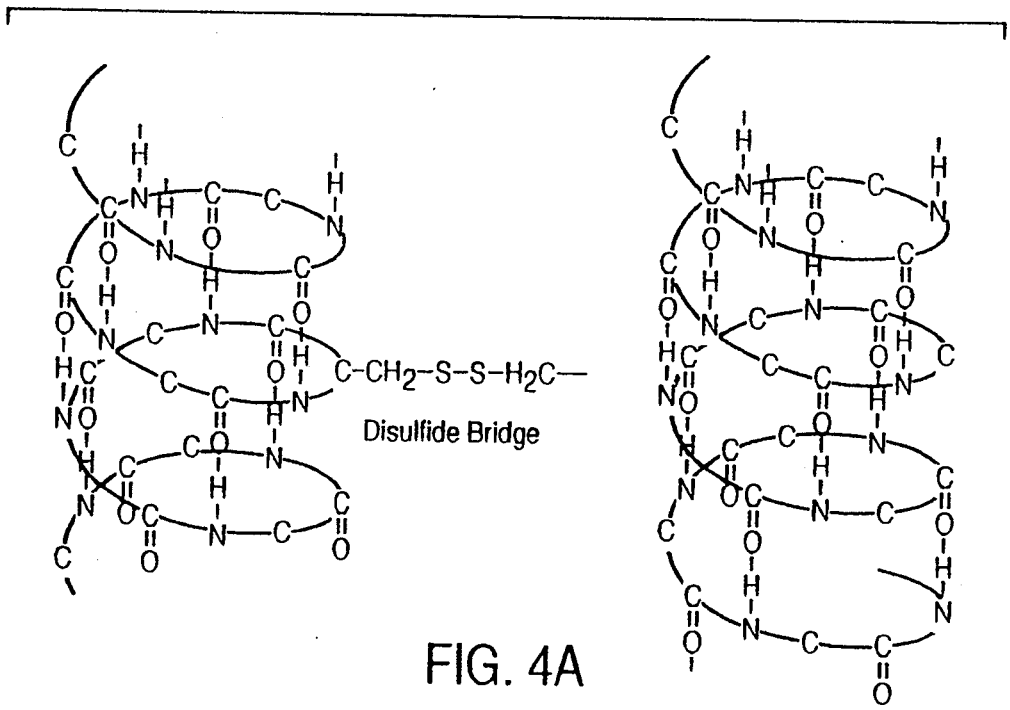
FIGS. 4A and 4B are simplified drawings of a disulfide bond before and after the application of mechanical stress.
Figure 4B:
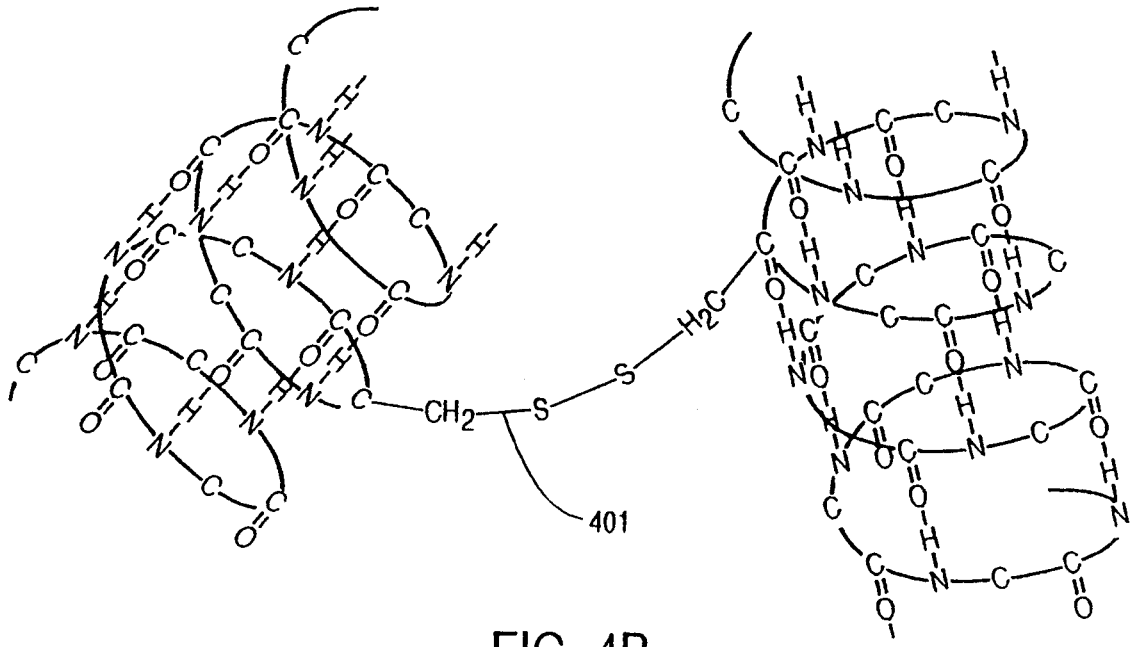

The stress initiation stage involves the mechanical pre-stressing of the disulfide bonds 203 to facilitate cleavage of the bonds. Once applied, this mechanical stress is preferably maintained during the entire RFT Method. A curling iron or a plurality of hair rollers are typically used to apply mechanical stress to hair. FIG. 3 shows a strand of hair 301 rolled around a typical hair roller 302. As the hair is rolled around the roller, external stress is placed on various parts of the strand. The external stress, in turn, creates internal stresses on the disulfide bonds which link the protein components in the hair fibers. FIGS. 4A and 4B are a simplified illustrations of the state of the disulfide bonds before and after the internal stress is applied.

The application of mechanical stress plays an important role in determining the shape of hair. The disulfide bonds which are subjected to the most stress will likely be the bonds that will cleave upon exposure to electromagnetic energy. In contrast, disulfide bonds which remain in a relatively unstressed state are less likely to be broken by electromagnetic energy. In effect, the application of mechanical stress accelerates the cleaving of those disulfide bonds which must be broken to reform the shape of the hair and leaves other disulfide bonds intact. Following the cleavage of these disulfide bonds, new disulfide bonds, linking either the same molecular components as those linked by the original disulfide bonds or different molecular components, are formed in stress-free positions and cause the hair to permanently adopt a new shape.

Following the application of mechanical stress during the stress initiation stage, the RFT application stage is commenced to effect cleavage of the disulfide bonds. The RFT application stage involves the direct coupling of electromagnetic energy ("RFT electromagnetic energy") from an external source into the disulfide bonds at the natural or resonant frequency of the bonds in order to cleave the bonds. The term resonant frequency, as used herein, and in the appended claims, is defined as that frequency, or series or combination of frequencies which, when coupled to selected molecular links, such as the disulfide bonds linking protein molecules in hair, causes the dissociation of the molecules by cleavage of the link. The cleaving of the disulfide bonds serves to relieve the internal stress on the bonds imposed by the external mechanical forces.

A multi-frequency electromagnetic wave generator is the preferred external source used to generate RFT electromagnetic energy at the natural resonant frequency of the disulfide bonds. The application of RFT electromagnetic energy to the disulfide bonds creates standing waves at the resonant frequency. As the amplitude of the standing waves increases, physical deformation of the disulfide bonds occurs. Ultimately, the RFT electromagnetic energy causes the disulfide bonds under the most stress to cleave.

The amount of RFT electromagnetic energy is preferably controlled such that the temperature of the disulfide bonds is kept slightly below 70° C., which is a sufficient temperature to accelerate the cleaving of the disulfide bonds without destroying the structure of the protein components. Unlike the heating process in conventional hair perming methods, RFT electromagnetic energy generates thermal energy on a localized level rather that heating the hair mass generally. This localized thermal effect increases the fluidity and plasticity of the hair components and the rate of sulfhydryl-disulfide exchange. Ultimately, the induced thermal effect facilitates and accelerates the reformation of new disulfide bonds in stress-free states.

The effectiveness of the disulfide bond cleavage can be accelerated by increasing the temperature of the water molecules in the vicinity of the disulfide bonds. The RFT electromagnetic energy may also be used to increase the thermal energy of these water molecules by including a frequency component of approximately 2450 Mhz. The water molecules that are heated may be either water molecules independently absorbed by the hair fibers or the water molecules within protein helices (hydrogen-bonded water).

Unlike conventional methods of cleaving disulfide bonds, the RFT Method does not require the use of chemicals or generalized thermal effects to cleave the bonds. Whereas the conventional methods employ a chemical solution treatment to cleave and reform disulfide bonds, the RFT Method can accomplish disulfide bond cleavage process more efficiently and more effectively because, being electronic, it accomplishes the cleaving process in less time than is required using conventional perming methods and avoids the cumulative adverse effects on the hair fibers which can result from exposure to caustic chemicals.

Although the cleaving process using conventional methods may be accelerated by the external application of heat to the hair during chemical treatment, such generalized application of heat exposes the scalp and head to uncomfortably high temperatures for relatively long periods of time. The RFT Method avoids the need for generalized heating of the hair mass because it relies on the coupling of electromagnetic energy at the natural resonant frequency of the disulfide bonds. Heat generated during the RFT Method results mainly from the localized heating of the water molecules in the vicinity of the disulfide bonds in order to accelerate the cleaving process. Thus, a person using the RFT Method does not experience the type of uncomfortably high temperatures which characterize conventional perming methods.

The RFT Method also has distinct advantages over other methods that employ electromagnetic waves to accelerate chemical perming processes. For instance, the method described in U.S. Pat. No. 3,863,653 issued to Boudouris et al. teaches the use of electromagnetic energy not as the means to cleave the disulfide bonds by direct coupling at the resonant frequency of the bonds, but rather as a means of raising the overall temperature of the hair fibers. Under that method, electromagnetic waves are applied to the hair to cause dielectric losses inside the hair fibers. The dielectric losses heat the hair fibers from the inside and thereby accelerate the chemical treatment. In contrast, the RFT Method employs electromagnetic waves at specific and predetermined frequencies corresponding to the natural resonant frequency of the disulfide bonds to cleave the bonds rather than to generate internal heating through dielectric losses. The RFT Method also does not require chemicals to cleave the disulfide bonds and thus eliminates the cumulative adverse effects of the caustic chemicals required with prior art electromagnetic energy methods that rely on dielectric losses.

Once the disulfide bonds have been cleaved, the reconfiguration stage is initiated to form new disulfide bonds. The cleavage of the stressed disulfide bonds during the RFT application stage generates free-standing sulfhydryl groups. At this stage, water molecules present in the hair or externally applied act to accelerate the reformation of disulfide bonds. The sulfhydryl groups react with disulfide molecules to form new stress-free disulfide bonds. The orientation of these disulfide bonds is dependent upon the mechanical stress applied to the hair fiber. New disulfide bonds are formed in positions which result in the lowest bond stresses.

To complete the reconfiguration stage, the external mechanical stress is removed from the hair fibers. At this time, the reconfigured disulfide bonds within each hair fiber will be in a relaxed state. The net result of the RFT Method is a new permanent shape to the hair.

Figure 5A:
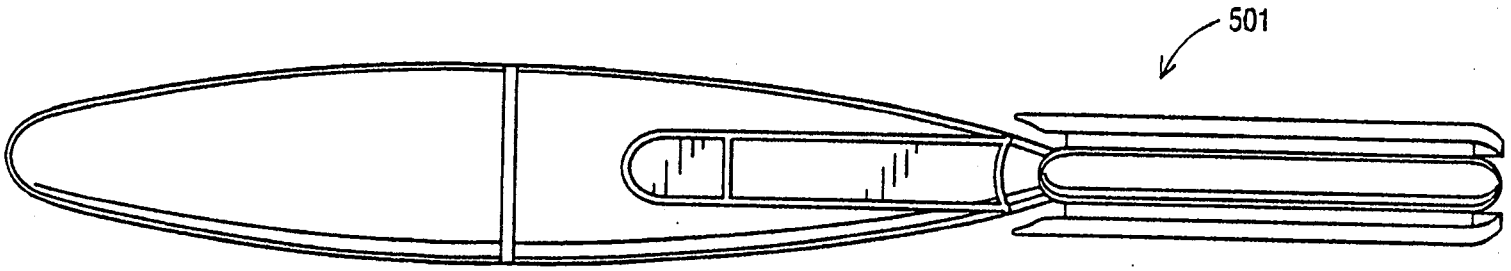
FIGS. 5A and 5B are drawings of the top and side view, respectively, of a perming appliance useful with the RFT Method of the present invention.
Figure 5B:
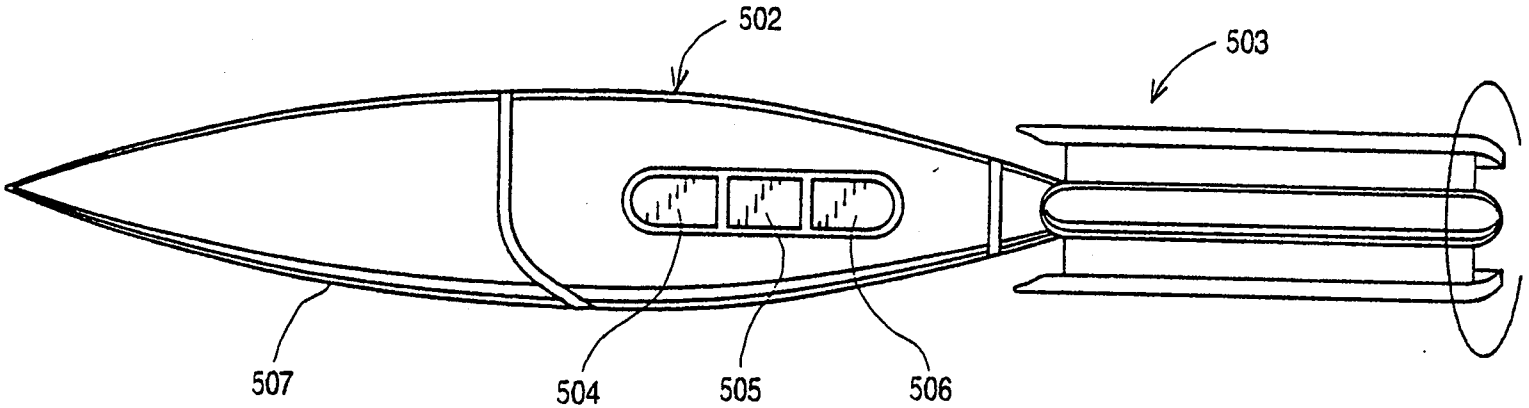

FIGS. 5A and 5B are a top view and a side view, respectively, of a perming appliance useful with the RFT method, specifically, a variable diameter curling device 501. Curling device 501 has external components, consisting of a housing unit 502, a variable diameter shaft 503, an on/off switch 504, a mode indicator 505, a safety interlock 506 and a reservoir 507. In addition, curling device 501 preferably contains control system components located inside the housing unit 502 as described below.

Figure 6:
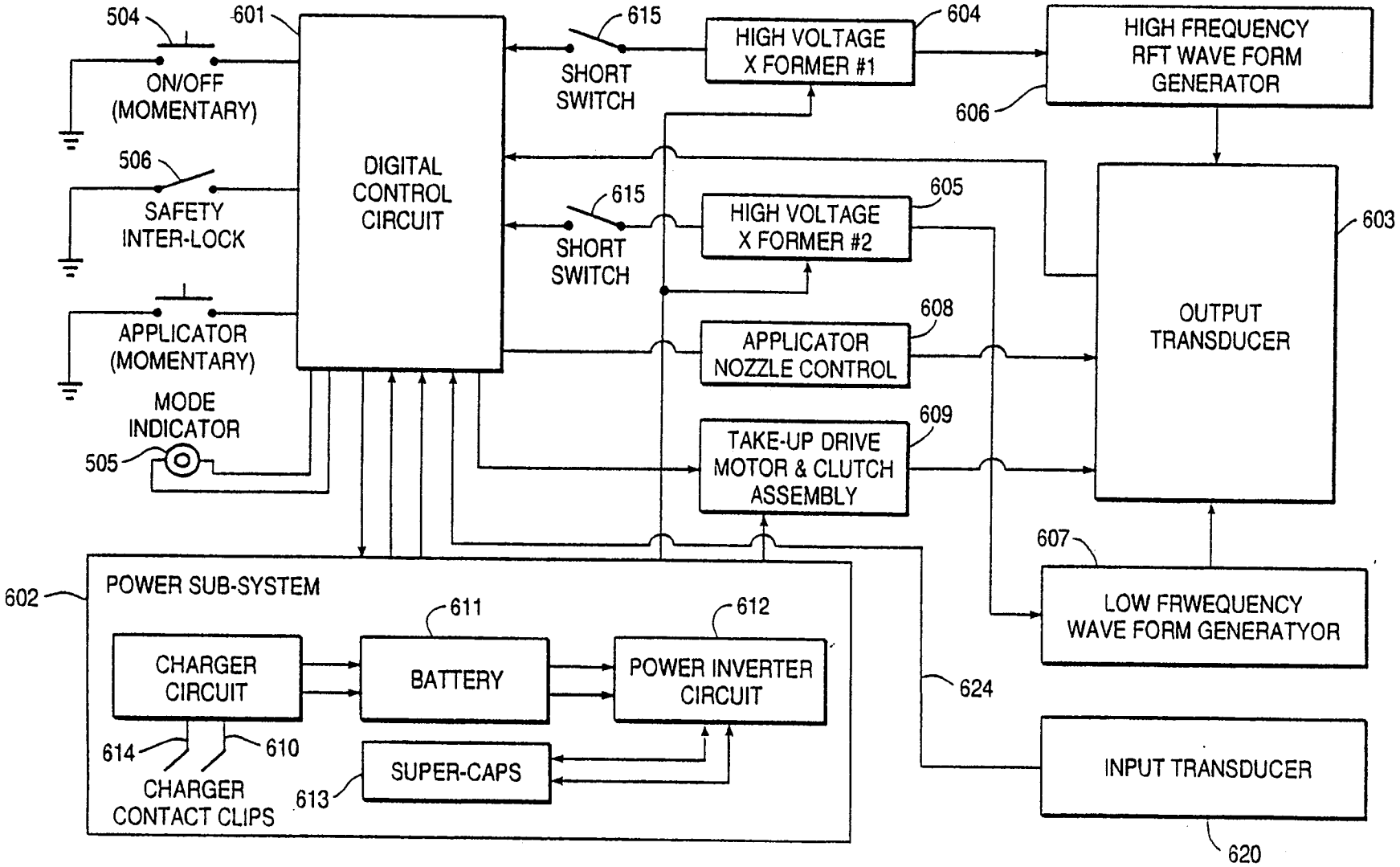
FIG. 6 is a block diagram of the internal electronic components of a perming appliance in accordance with the present invention.

FIG. 6 is a block diagram showing the internal electronic components of curling device 501. These include an electronic control circuit 601, a power subsystem 602, a signal transducer 603, a pair of high voltage transformers, 604 and 605, a high frequency RFT wave form generator 606, a low frequency wave form generator 607, an applicator nozzle control 608, and a take-up drive motor and clutch assembly 609.

Electronic control circuit 601 acts as the control center for curling device 501 by monitoring and controlling the operation of its various components. More specifically, curling device 501 is enabled or disabled by electronic control circuit 601 in accordance with the status of on/off switch 504. Activation of switch 504 initiates the operation of curling device. If switch 504 is activated while curling device is already in operation, electronic control circuit 601 will suspend operation. Thereafter, electronic control circuit 601 resumes operation of curling device if switch 504 is again activated by a coded reset sequence, e.g., a series of four ON and OFF operations, and/or after a predetermined time interval, for example, one minute, in order to avoid accidental reactivation of the cleaving process; otherwise, the operation of curling device remains terminated. Electronic control circuit 601 is grounded through safety interlock 506 by means of which the curling device may be disabled.

At all times during the RFT Method, the state of curling device 501 is indicated by mode indicator 505. Mode indicator 505 is a light that illuminates when the curling device is in operation. Moreover, mode indicator 505 flashes intermittently when the operation of the curling device is temporarily suspended.

Curling device 501 is powered by the power subsystem 602, which preferably comprises a charger circuit 610, a battery 611, a power inverter circuit 612 and a super capacitor 613. The power subsystem provides A/C electrical current to various components, including electronic control circuit 601, high voltage transformers 604 and 605 and take-up drive motor and clutch assembly 609. Charger circuit 610 receives alternating current (NC) electrical power via the charger contact clips 614 from an external electrical source (such as a common household electrical outlet). Charger circuit 610 converts the alternating current (NC) electrical power to direct current (D/C) electrical power and stores it in battery 611. As electrical power is required by the components of curling device 501, power inverter circuit 612 converts the D/C power from battery 611 back into NC power and transfers it to super-capacitor 613. Charged super-capacitor 613 supplies A/C power to components of curling device 501 in accordance with instructions from electronic control circuit 601.

The following is a description of the functions of various components of curling device 501 during the three stages of the RFT Method.

During the stress initiation stage, electronic control circuit 601 engages take-up drive motor and clutch assembly 609, which in turn activates variable diameter shaft 503. The functions of shaft 503 are to grasp and retain a lock of hair in a curl shape during the RFT Method and thereafter release the hair upon completion of the RFT Method. Shaft 503 can be adjusted to vary the size of curls by enlarging or reducing the diameter of the shaft and thus serves as the tool used to apply external stress on hair fibers during the stress initiation stage of the RFT Method.

In the RFT application stage, electronic control circuit 601 initiates the process by engaging power subsystem 602 to provide NC electrical power to high voltage transformers 604 and 605. Upon receipt of electrical power, high voltage transformer 1 604 generates approximately 2000 VAC and supplies it to high frequency RFT wave form generator 606. Similarly, high voltage transformer 2 605 accepts electrical current from power subsystem 602 and converts it into approximately 100 VAC. The 100 VAC is then supplied to low frequency wave form generator 607. A short switch 615 is connected to each of the high voltage transformers to detect short circuits. A signal is sent to electronic control circuit 601 to disable curling device 501 upon detection of a short circuit in the circuits of either of the high voltage transformers.

As high frequency RFT wave form generator 606 receives the 2000 VAC from high voltage transformer 604, it generates RFT electromagnetic waves at various frequencies spanning frequency range of $2*10^{13}$ Hz to $1*10^{15}$ Hz (corresponding to the natural resonant frequency of disulfide bonds) and also a frequency of 2450 Mhz, which is the resonant frequency of the water molecules. These RFT signals are transmitted to signal transducer 603 (containing within curling device 501) which applies the RFT electromagnetic energy to the hair fibers to cleave disulfide bonds.

Similarly, low frequency wave form generator 607 uses the 100 VAC output from high voltage transformer 2 605 to produce electromagnetic signals having a frequency of approximately 30 Hz. These electromagnetic signals are also transmitted to signal transducer 603. The 30 Hz electromagnetic signal is designed to transfer vibrational energy to the hair and thus provide additional stress on the disulfide bonds to aid and enhance the cleaving of the disulfide bonds by the RFT electromagnetic energy.

Curling device 501 preferably also contains at least one input transducer 620 for monitoring one or more physical attributes of the hair such as temperature or reflectivity. The output of input transducer 620 is supplied to electronic control circuit 601 via line 624. Electronic control circuit 601 uses these signals to implement a feedback control system. For example, during the RFT application stage, a thermostat (which is a type of input transducer) can be used to monitor the thermal effects of the RFT electromagnetic energy on the hair. Upon detecting the desired effect, the thermostat signals electronic control circuit 601 to end the RFT application stage, and to proceed with the reconfiguration stage of the RFT Method.

Other examples of input transducers are optical or infra-red sensors. These sensors measure changes in the optical or infra-red spectra resulting from changes in the reflectivity of hair during the RFT processes. The results of these measurements can be supplied to electronic control circuit 601 as additional parameters to the feedback control system.

Optionally, in the reconfiguration stage, electronic control circuit 601 may also activate applicator nozzle control 608 which draws water from reservoir 507 and dispenses a water mist through signal transducer 603 onto the hair fibers. The water molecules facilitate reactions between the disulfide molecules and the sulfhydryl groups to form new disulfide bonds. Again, the thermostat monitors the hair fibers to determine whether the desired effects have been achieved. Upon receiving confirmation of the desired effects from the thermostat, electronic control circuit 601 instructs variable diameter shaft 503 to release the hair fibers from the curl position. At the completion of the reconfiguration stage, the hair will have taken on a new shape.

Variable diameter curling device 501 is a preferred embodiment of the present invention; however, the RFT Method may be implemented by various other apparatus, as will be readily apparent to those skilled in the art.

Although specific embodiments of the present invention have been shown and described, it will be understood that various modifications may be made without departing from the scope and spirit of this invention. For example, although the RFT Method is preferably used to perm or straighten hair fibers, the RFT Method also may be adapted to treat various other type of keratinic fibers, such as wool, and may even be used to alter the shape or other characteristics of synthetic fibers and polymers generally.

What is claimed is:

1. A method for changing a characteristic of a material, said characteristic being determined by the nature of the bond coupling certain molecular components, said method comprising the steps of:

exposing said material to electromagnetic energy having a frequency range related to the bond coupling a first molecular component with at least one other molecular component; and applying stress to said molecular components and said bond during the time that said material is exposed to said electromagnetic energy, said bond being broken by the simultaneous application of said electromagnetic energy and said stress and said broken bond being subsequently reformed, based at least in part on said stress, to create a different coupling between said first molecular component and at least one other molecular component.

2. The method of claim 1 wherein said frequency range corresponds to the resonant frequency of said bond.

3. The method of claim 1 wherein said bond couples said first molecular component with a second molecular component and wherein said reformed bond couples said first molecular component with a third molecular component.

4. The method of claim 1 wherein said material is hair, said bond couples said first molecular component with a second molecular component in a first orientation, said reformed bond couples said first molecular component with said second molecular component in a second orientation, and said characteristic is the shape of the hair, said shape having a first form determined by said first molecular orientation and said shape having a second form determined by said second molecular orientation.

5. The method of claim 1 wherein said material comprises protein.

6. The method of claim 5 wherein said material comprises cystine.

7. The method of claim 6 wherein said material comprises animal hair.

8. The method of claim 7 wherein said material comprises human hair.

9. The method of claim 7 wherein said material comprises wool.

10. The method of claim 1 wherein said material comprises a polymer.

11. The method of claim 10 wherein said material comprises a synthetic fiber.

12. The method of claim 1 wherein said material contains water molecules and wherein said electromagnetic energy includes a frequency which increases the thermal energy of said water molecules.

13. The method of claim 1 further comprising the step of adding water to said material for facilitating the formation of said reformed bond.

14. A method for changing a characteristic of a material, said characteristic being determined by the nature of the bond coupling certain molecular components, said method comprising the steps of:

exposing said material to electromagnetic energy having a frequency range related to the bond coupling a first molecular component with at least one other molecular component, said frequency range having a value above $1\times10^{13}$ hertz, and applying stress to said molecular components and said bond during the time that said material is exposed to said electromagnetic energy, said bond being broken by the simultaneous application of said electromagnetic energy and said stress and said broken bond being subsequently reformed, based at least in part on said stress, to create a different coupling between said first molecular component and at least one other molecular component.

15. The method of claim 14 wherein said frequency range is between $1*10^{13}$ hertz and $2*10^{15}$ hertz.

16. The method of claim 14 wherein said material is hair, said bond is a disulfide bond coupling said first molecular component with a second molecular component in a first orientation, said reformed bond couples said first molecular component with said second molecular component in a second orientation, and said characteristic is the Shape of the hair, said shape having a first form determined by said first molecular orientation and said shape having a second form determined by said second molecular orientation.

* * * * *